US010436058B2

(12) United States Patent
Bennauer et al.

(10) Patent No.: US 10,436,058 B2
(45) Date of Patent: Oct. 8, 2019

(54) TURBINE CONTROL UNIT COMPRISING A THERMAL STRESS CONTROLLER AS A MASTER CONTROLLER

(71) Applicant: Siemens Aktiengesellschaft, Munich (DE)

(72) Inventors: Martin Bennauer, Bottrop (DE); Matthias Heue, Bochum (DE); Martin Ophey, Straelen (DE); Christoph Schindler, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 253 days.

(21) Appl. No.: 15/519,704

(22) PCT Filed: Oct. 5, 2015

(86) PCT No.: PCT/EP2015/072926
§ 371 (c)(1),
(2) Date: Apr. 17, 2017

(87) PCT Pub. No.: WO2016/066376
PCT Pub. Date: May 6, 2016

(65) Prior Publication Data

US 2017/0241285 A1 Aug. 24, 2017

(30) Foreign Application Priority Data

Oct. 27, 2014 (EP) ..... 14190471

(51) Int. Cl.
*F01D 25/24* (2006.01)
*F01D 19/02* (2006.01)
(Continued)

(52) U.S. Cl.
CPC ..... *F01D 19/02* (2013.01); *F01D 5/06* (2013.01); *F01D 5/12* (2013.01); *F01D 21/003* (2013.01);
(Continued)

(58) Field of Classification Search
CPC . F01D 19/02; F01D 25/24; F01D 5/12; F01D 5/06; F01D 21/003; F01K 13/02; F05D 2270/3032; F05D 2270/053
(Continued)

(56) References Cited

U.S. PATENT DOCUMENTS 4,280,060 A 7/1981 Kure-Jensen et al.
5,044,152 A 9/1991 Hoizumi et al.
(Continued)

FOREIGN PATENT DOCUMENTS

GB 2074757 A 11/1981
JP H08158807 A 6/1996
(Continued)

OTHER PUBLICATIONS

RU search report dated Jun. 9, 2018, for RU patent application No. 2017118233/06.
(Continued)

*Primary Examiner* — Hai H Huynh
(74) *Attorney, Agent, or Firm* — Beusse Wolter Sanks & Maire

(57) ABSTRACT

A turbine control unit and method for controlling a turbine, in particular for controlling the start-up of a turbine, the unit being designed as a cascade controller having a master controller and an inner controller, the master controller being a thermal stress controller for the components subjected to thermal stress.

15 Claims, 1 Drawing Sheet

(51) Int. Cl.

| | |
|---|---|
| ***F01K 13/02*** | (2006.01) |
| ***F01D 5/06*** | (2006.01) |
| ***F01D 5/12*** | (2006.01) |
| ***F01D 21/00*** | (2006.01) |

(52) U.S. Cl.
CPC ..... *F01D 25/24* (2013.01); *F01K 13/02* (2013.01); *F05D 2270/053* (2013.01); *F05D 2270/3032* (2013.01)

(58) Field of Classification Search
USPC ..... 415/1, 47
See application file for complete search history.

(56) References Cited

U.S. PATENT DOCUMENTS

| | | | |
|---|---|---|---|
| 2006/0233637 | A1 | 10/2006 | Yakushi et al. |
| 2013/0042624 | A1 | 2/2013 | Botarelli |
| 2014/0260254 | A1 | 9/2014 | Yoshida et al. |
| 2014/0260284 | A1 | 9/2014 | Kim et al. |

FOREIGN PATENT DOCUMENTS

| | | | | | |
|---|---|---|---|---|---|
| JP | H08303210 | A | | 11/1996 | |
| JP | H08326506 | A | | 12/1996 | |
| JP | 3673017 | A | | 12/1997 | |
| JP | 2002106305 | A | | 4/2002 | |
| JP | 3673017 | B2 | | 7/2005 | |
| JP | H09317404 | | * | 7/2005 | ..... F01D 19/02 |
| JP | 2014177929 | A | | 9/2014 | |
| RU | 2012122725 | A | | 1/2014 | |

OTHER PUBLICATIONS

EP Search Report dated Apr. 9, 2015, for EP patent application No. 14190471.4.
International Search Report dated Dec. 8, 2015, for PCT/EP2015/072926.
IPPR (PCT/IPEA/408) dated Sep. 28, 2016, for PCT/EP2015/072926.

* cited by examiner

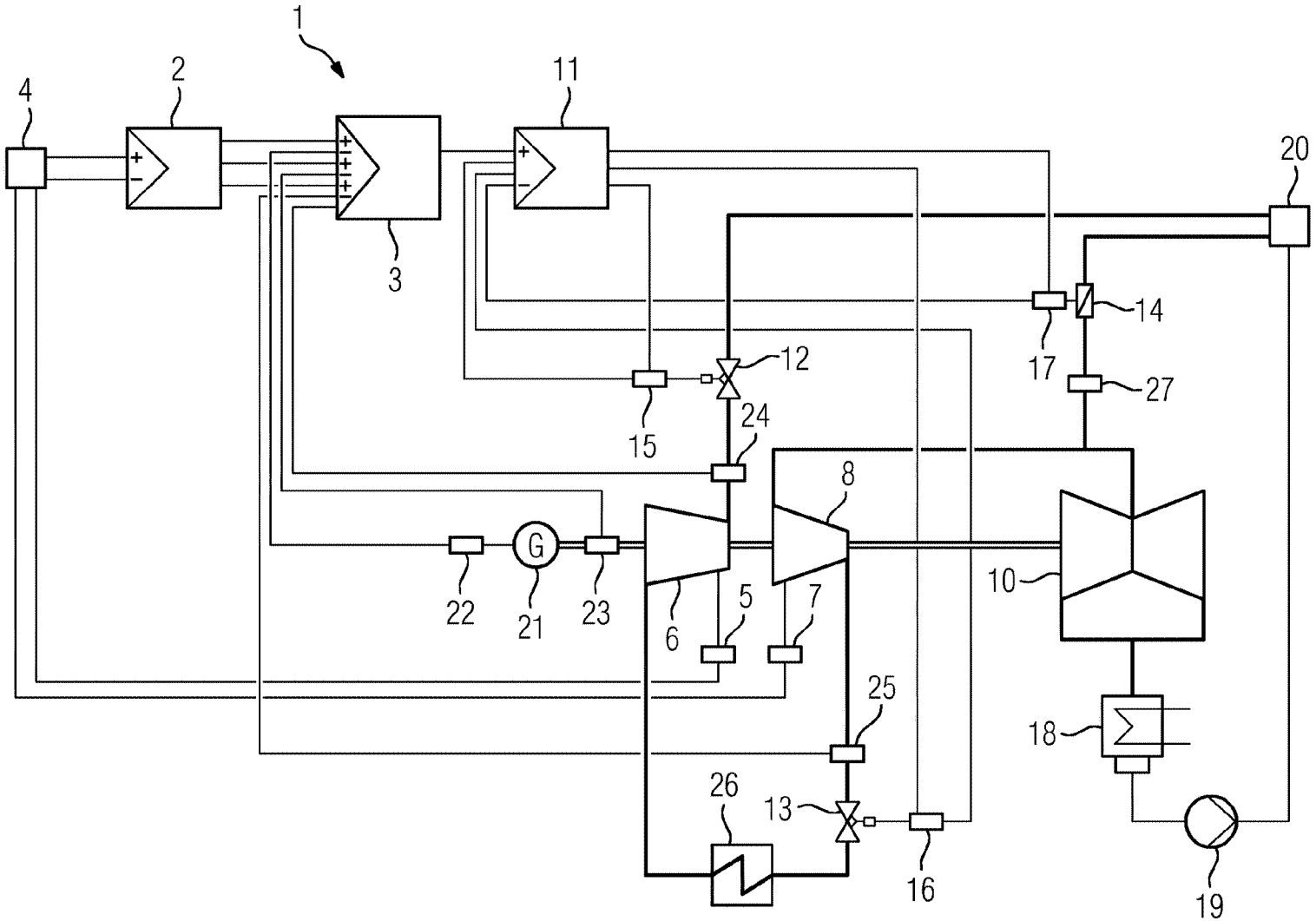
1
2
3
4
5
6
7
8
10
11
12
13
14
15
16
17
18
19
20
21
22
23
24
25
26
27
G

TURBINE CONTROL UNIT COMPRISING A THERMAL STRESS CONTROLLER AS A MASTER CONTROLLER

CROSS REFERENCE TO RELATED APPLICATIONS

This application is the US National Stage of International Application No. PCT/EP2015/072926 filed Oct. 5, 2015, and claims the benefit thereof. The International Application claims the benefit of European Application No. EP14190471 filed Oct. 27, 2014. All of the applications are incorporated by reference herein in their entirety.

FIELD OF INVENTION

The invention relates to a turbine control unit for controlling a turbine, in particular for controlling the starting of a turbine, which is embodied as a cascade controller.

BACKGROUND OF INVENTION

When turbines, in particular steam turbines, start up, an excessively rapid rise in temperature has to be avoided in order to avoid damage to the components. Therefore, the temperatures of components which are subjected to thermal stress are monitored. If the temperatures or the rise in temperature exceeds a setpoint value, a controller of the turbine power level is acted on to stop the increase in power. In some cases this results in delays during the starting of the turbine.

GB 2 074 757 A presents a method and an arrangement for controlling the thermal stress of components of a steam turbine at maximum load rates and load-relief rates during the running up, deactivation and other periods of the change in load. A load rate for each of a plurality of preselected turbine components is calculated from monitored and derived variables, and the lowest rate is selected for the control. At the same time, the steam action operating mode of the turbine is directed automatically either to the partial arc operating mode or the full arc operating mode, depending on the need to reduce the stress.

U.S. Pat. No. 4,208,060 A presents a monitoring control system for a steam turbine generator having a hierarchy of microcomputer partial systems which cooperate interactively with a conventional analog electrohydraulic control system in order to permit control and monitoring during all the operating phases of the turbine generator.

US 2006/233637 A1 presents a turbine start controller with an optimum start control unit for predicting thermal stress which is determined into the future in a turbine rotor during a prediction period on the basis of the current time, wherein a turbine acceleration rate and a load increase rate are used as control variables.

U.S. Pat. No. 5,044,152 A presents a method for operating a combined power plant with a gas turbine system and an evaporator in which steam is generated from the heat of the turbine exhaust gases and fed to a steam turbine which is operated by the steam which is generated in this way. An inlet into the gas turbine system is controlled on the basis of the state of the evaporator or of the steam turbine.

SUMMARY OF INVENTION

The object of the invention is as far as possible to avoid, and at least reduce, these delays and, at the same time prevent damage to components. This object is achieved, in particular, by the independent claims. The dependent claims specify advantageous developments.

According to the invention, a turbine control unit for controlling a turbine, in particular for controlling the starting of a turbine, is proposed which is embodied as a cascade controller.

As is customary in the field, a cascade controller is understood to be a controller in which at least two control circuits are connected one inside the other. In this context, an outer control circuit, referred to as a master controller, is present. This has the object of predefining, or at least influencing, setpoint values for an inner control circuit, that is to say a subordinate control circuit.

A thermal stress controller for the temperature of components which are subjected to thermal stress is present here as master controller. The master controller therefore has the function of predefining or influencing the setpoint values for an inner control circuit in such a way that excessive thermal stress is avoided. Hitherto, when starting a turbine as usual with a controller for the turbine power level, the power, to be more precise the increase in power, is controlled. In order to avoid excessive thermal stress, the temperature is measured and when excessive thermal stress occurs the starting is stopped. The increase in power is therefore interrupted. Although this avoids excessive thermal stress of components, a waiting period has to be accepted until the turbine can reach the desired power level.

If, on the other hand, as provided according to the invention a thermal stress controller is provided as a master controller for the temperature of components which are subjected to thermal stress, it can be ensured that the permissible thermal stress is largely used up, that is to say for example when starting the increase in the power of the turbine it is selected to be as high as possible without exceeding the permissible thermal stress of the components. It is therefore possible to increase power more quickly and reach a desired turbine power level more quickly.

In addition to the thermal stress controller which is embodied as a master controller, an inner controller is always present. The thermal stress controller transfers a suitable setpoint value to the inner controller in order to ensure that the turbine is controlled in such a way that a permissible thermal stress is not exceeded.

The invention is aimed, in particular, at steam turbines in which the thermal stress, in particular the thermal stress when starting, constitutes a significant problem. However, it cannot be ruled out that the invention is also used, for example, in gas turbines.

The inner controller is in one important embodiment a turbine controller, in particular a controller of the turbine power level. Such turbine controllers are known in the prior art and are very suitable for controlling turbines, in particular when starting the turbine. In this case, the thermal stress controller transfers a setpoint value for the power level of the turbine to the inner controller. As will be discussed later in more detail, this can also be a setpoint value for the increase in power.

The main application case is certainly the starting of a turbine. However, it would also be conceivable, for example in the full load operating mode, to avoid overheating by the thermal stress controller which is embodied as a master controller.

A thermal stress calculation unit is usually present in order to predefine at least one setpoint value to the thermal stress controller. The thermal stress calculation unit calculates, usually on the basis of data stored in databases, whether a rise in temperature is permissible.

In one important embodiment, the thermal stress controller is designed to ensure for such control of the turbine that a desired rise in temperature over time, that is to say a certain rise in temperature per unit of time, is not exceeded. Usually it is decisive, in particular, when starting the turbine, not to exceed an absolute temperature. In this context, it is necessary to bear in mind that, of course, there is a temperature which must not be exceeded. However, in order to avoid unacceptable material stresses it is decisive, during the starting process, that the temperature does not rise too quickly. Therefore, the thermal stress controller must normally ensure that the temperature does not rise too quickly.

Coming back to the thermal stress calculation unit already mentioned this means correspondingly that the thermal stress calculation unit can infer a rise in temperature from the sensed temperature values and their chronological sequence. Furthermore, this rise in temperature can be compared with stored data. This makes it possible to determine whether the rise in temperature can be increased, has to be reduced or is to remain the same. This information can be transferred to the thermal stress controller. The thermal stress controller can generate a suitable setpoint value for the inner controller from this information.

In one embodiment, the thermal stress controller is designed to avoid thermal stress which is caused by temperature differences. In some cases, thermal stress also arises from different temperatures within one component or from different temperatures between various components. It can therefore be problematic, for example, if blades of the turbine expand as a result of heating and a housing of the turbine expands more slowly owing to slower heating. It is therefore necessary in some cases to detect temperature differences which trigger thermal stress, and to avoid them through control.

In one embodiment, the controller of the turbine power level is designed to generate setpoint values for position controllers which control the position of actuating valves. The actuating valves significantly influence the quantity of steam respectively flowing through and therefore the power level or the power profile of the turbine. In this embodiment, the turbine control unit therefore has double cascading. The thermal stress controller is in the first instance present as a superordinate master controller which generates setpoint values for the controller of the turbine power level. The controller of the turbine power level in turn generates setpoint values for the position controllers.

In one embodiment, the turbine control unit is designed to control partial turbines, in particular a high-pressure turbine, a medium-pressure turbine and a low-pressure turbine, separately. This allows for the fact that the power level can be increased differently in particular owing to different thermal stresses. Admittedly, completely separate control usually cannot be implemented. Even if different steam paths are available, certain dependencies of power levels of the individual partial turbines can arise from the peripheral condition that steam from the high-pressure turbine flows into the medium-pressure turbine and from there into the low-pressure turbine. Nevertheless it is advantageous basically to be able to control individual partial turbines separately. This permits, for example, the power level of a partial turbine to be able to be increased more quickly, while in order to avoid undesired thermal stress the power level of another partial turbine can be increased more slowly.

In one embodiment, temperature sensors are mounted at various locations on the turbine, in particular on a high-pressure turbine and/or on a medium-pressure turbine. The high-pressure turbine and the medium-pressure turbine are components which are subjected to greater thermal stress with the result that temperature sensors are necessary particularly there. In many cases, it is, of course, appropriate also to mount temperature sensors in the low-pressure turbine.

The invention also relates to a method for controlling a turbine having a cascade controller comprising a master controller and an inner controller, wherein the master controller senses thermal stress of the turbine and transfers setpoint values to the inner controller which are such that undesired thermal stress of the turbine is avoided. Further explanations of the method will not be given here. Reference is made to the explanations relating to the turbine control unit which is described above and which can be used to carry out the method.

In one embodiment of the method there is provision that the master controller senses the thermal stress of the turbine by means of a rise in temperature over time, that is to say by means of a rise in the temperature per unit of time, and determines the thermal stress arising therefrom, wherein in the case of excessively high thermal stress the setpoint value is transferred to the inner controller to reduce the increase in power of the turbine, in the case of thermal stress within a desired range the setpoint value is transferred in order to be able to maintain the increase in power, and in the case of thermal stress below a threshold value the setpoint value is transferred in order to be able to boost the increase in power. It is clear that excessively high thermal stress does not mean here that the thermal stress is already unacceptably high. Excessively high thermal stress means merely that a limiting value for the control is exceeded. The control is intended to just avoid unacceptably high thermal stress. This control permits rapid starting of a turbine without unacceptably high thermal stress.

BRIEF DESCRIPTION OF THE DRAWINGS

Further details will be explained with reference to a figure which shows a turbine control unit in a schematic view.

DETAILED DESCRIPTION OF INVENTION

A turbine control unit 1 is shown. A thermal stress controller 2 serves as a master controller and transfers setpoint values to an inner controller 3 which is embodied as a controller of the turbine power level. A thermal stress calculation unit 4 is connected upstream of the thermal stress controller 2. Said thermal stress calculation unit 4 evaluates signals which originate from temperature sensors 5 for a high-pressure turbine 6 and from temperature sensors 7 for a medium-pressure turbine 8. Even though the figure respectively illustrates just one temperature sensor in a schematic view, there are in fact appropriately a plurality of temperature sensors. The thermal stress calculation unit 4 determines thermal stress of the high-pressure turbine 6 of the medium-pressure turbine 8 and of a low-pressure turbine 10 from the signals of the temperature sensors 5 and 7 using stored data. In this context, in particular the rise in temperature over time is considered, which rise must not be too high in order to avoid excessively high thermal stresses.

The thermal stress calculation unit 4 communicates to the thermal stress controller 2 whether the thermal stress is to be increased, is to remain the same or is to drop. As a function of this, the thermal stress controller 2 transfers suitable setpoint values to the controller 3 of the turbine power level, as a function of which setpoint values it is determined whether a rise in power level of the turbine is to be reduced, boosted or kept constant. This is carried out separately in each case for the high-pressure turbine 6, the medium-pressure turbine 8 and the low-pressure turbine 10.

The controller 3 of the turbine power level transfers corresponding setpoint values to a position controller 11. The position controller 11 controls, on the basis of the transferred setpoint values, a position of a live steam actuating valve 12, which influences the supply of steam to the high-pressure turbine 6, a position of an interception actuating valve 13 which influences the supply of steam to the medium-pressure turbine 8, and a position of a supply steam valve 14 which influences the supply of steam to the low-pressure turbine 10.

A position meter 15 is situated on the live steam actuating valve 12, a position meter 16 on the interception actuating valve 13, and a position meter 17 on the supply steam valve 14. The position meters 15, 16 and 17 transfer values to the position controller 11. Therefore the position controller 11 has the information as to whether the position of the live steam actuating valve 11, interception actuating valve 13 and supply steam valve 14 has assumed the respectively desired value or whether opening or closing is necessary.

At this point details will briefly be given of a simplified steam circuit. Wet steam coming from the low-pressure turbine 10 is condensed in a condenser 18. The water which is produced here is fed into a steam generator 20 with a feed water pump 19. From said steam generator 20 the steam passes through the live steam actuating valve 12 to the high-pressure turbine 6. Steam coming from the high-pressure turbine is heated in a reheater 26. The steam flows from the reheater 26 through the interception actuating valve 13 into the medium-pressure turbine 8. After relaxing in the medium-pressure turbine 8, the steam flows into the low-pressure turbine 10. In this context, steam coming from the steam generator 20 can be added depending on the degree of opening of the supply steam valve 14.

The high-pressure turbine 6, the medium-pressure turbine 8 and the low-pressure turbine 10 together drive a generator 21. The power level of said generator 21 is determined with a power meter 22 and transferred to the controller 3 of the turbine power level. In addition, a rotational speed meter 23 is provided which supplies the controller 3 of the turbine power level with the rotational speed of the turbine and generator 21.

There is a pressure meter 24 downstream of the live steam actuating valve 12 in the direction of flow, a pressure meter 25 downstream of the interception actuating valve 13, and a pressure meter 27 downstream of the supply steam valve 14. The respectively sensed pressure values are transferred to the controller 3 of the turbine power level.

Although the invention has been illustrated and described in detail by means of the preferred exemplary embodiment, the invention is not limited by the disclosed examples, and other variations can be derived therefrom by a person skilled in the art without departing from the scope of protection of the invention.

The invention claimed is:

1. A turbine control unit for controlling a turbine, comprising:

a cascade controller having a master controller and an inner controller, wherein the master controller is a thermal stress controller for the temperature of components which are subjected to thermal stress, and wherein the turbine control unit is designed to control partial turbines separately.

2. The turbine control unit as claimed in claim 1, wherein the inner controller comprises a turbine controller that controls a turbine power level of each of the partial turbines.

3. The turbine control unit as claimed in claim 2, wherein the turbine controller that controls the turbine power level is designed to generate setpoint values for position controllers which can control the position of an actuating valve for each respective partial turbine.

4. The turbine control unit as claimed in claim 1, further comprising:

a thermal stress calculation unit that predefines at least one setpoint value to the thermal stress controller.

5. The turbine control unit as claimed in claim 1, wherein the thermal stress controller is designed to ensure for such control of the partial turbines that a desired rise in temperature over time is not exceeded.

6. The turbine control unit as claimed in claim 1, wherein the thermal stress controller is designed to avoid thermal stress which is caused by temperature differences.

7. The turbine control unit as claimed in claim 1, further comprising:

a temperature sensor associated with each of a plurality of the partial turbines.

8. The turbine control unit as claimed in claim 7, wherein the temperature sensors are mounted on a high-pressure turbine and/or on a medium-pressure turbine.

9. The turbine control unit as claimed in claim 1, wherein the turbine control unit controls the starting of each of the partial turbines.

10. The turbine control unit as claimed in claim 1, wherein the partial turbines comprise a high-pressure turbine, a medium-pressure turbine and a low-pressure turbine.

11. A method for controlling a turbine having a cascade controller comprising a master controller and an inner controller, the method comprising:

sensing by the master controller thermal stress of each of multiple partial turbines, and transferring individual setpoint values to the inner controller for the partial turbines which are such that undesired thermal stress of each of the partial turbines is avoided.

12. The method as claimed in claim 11, wherein the master controller senses the thermal stress by a rise in temperature over time for a plurality of the partial turbines, and determines the thermal stress arising therefrom, wherein in the case of excessively high thermal stress in any one of the partial turbines, the respective individual setpoint value is transferred to the inner controller to reduce an increase in power of the respective turbine, in the case of thermal stress within a desired range the setpoint value is transferred in order to be able to maintain the increase in power, and in the case of thermal stress below a threshold value the setpoint value is transferred in order to be able to boost the increase in power.

13. A method for controlling a turbine power plant comprising a high pressure turbine, a medium pressure turbine and a low pressure turbine, the method comprising:

measuring a temperature rise over time in at least the high pressure turbine and the medium pressure turbine;

using the measured temperature rises over time and stored data to calculate in a thermal stress calculation unit an individual thermal stress parameter for each of the high pressure turbine, the medium pressure turbine and the low pressure turbine;

using the individual thermal stress parameters to determine in a master thermal stress controller an individual thermal stress setpoint for each of the high pressure turbine, the medium pressure turbine and the low pressure turbine separately; and using the individual thermal stress setpoints in an inner turbine control unit to control a power level for each of the high pressure turbine, the medium pressure turbine and the low pressure turbine individually such that power level over time in each of the high pressure turbine, the medium pressure turbine and the low pressure turbine is controlled differently in order to avoid an undesired thermal stress in any of the turbines.

14. The method of claim 13, further comprising controlling the power levels by controlling with a position controller a respective actuation valve for each of the high pressure turbine, the medium pressure turbine and the low pressure turbine separately.

15. The method of claim 14, further comprising measuring a position of each of the respective actuation valves separately and using the respective measured positions to determine in the position controller whether a desired position for each valve has been achieved or if further opening or closing of a respective valve is needed.

* * * * *